US005600925A

United States Patent [19]

Hoogervorst

[11] Patent Number: 5,600,925

[45] Date of Patent: Feb. 11, 1997

[54] ROOFTOP SKYLOUNGE HAVING HEMISPHERICAL DOME AND WRAPAROUND SEATING FOR PANORAMIC VIEWING OF COUNTRYSIDE, SNOWSTORMS, SUNSETS SUNRISES AND STARS

[76] Inventor: Gary W. Hoogervorst, 9 Heather Dr., Center Moriches, N.Y. 11934

[21] Appl. No.: 422,340

[22] Filed: Apr. 14, 1995

[51] Int. Cl.[6] ..... E04E 7/18

[52] U.S. Cl. ..... 52/200

[56] References Cited

U.S. PATENT DOCUMENTS

| | | | |
|---|---|---|---|
| 106,967 | 8/1870 | Snead . | |
| D. 233,371 | 10/1974 | Fila . | |
| 2,258,724 | 4/1938 | Wagner et al. . | |
| 2,659,462 | 9/1948 | Schwartz et al. | 189/64 |
| 3,212,220 | 5/1963 | Boniecki et al. | 52/80 |
| 3,455,069 | 4/1967 | Keyes | 52/73 |
| 3,475,868 | 12/1967 | Johnson | 52/2 |
| 4,963,009 | 10/1990 | Gernet . | |

*Primary Examiner*—Carl D. Friedman
*Assistant Examiner*—Aimee McTigue
*Attorney, Agent, or Firm*—Ware, Fressola, Van Der Sluys & Adolphson

[57] ABSTRACT

A skylounge is provided for mounting over an opening cut into a roof of a house. The skylounge includes a base member, a clear hemispheric dome arranged on the base member, and means for fastening the base member and the clear hemispheric dome together. The base member has mounting brackets for firmly attaching the skylounge to the roof of the house, has an entry opening for permitting users to enter the skylounge through the opening cut in the roof of the house, and has a wraparound seating area for seating 6 adult users. The clear hemispheric dome is arranged on the base member for providing users seated on the wraparound seating area a panoramic view from the roof of the house for viewing the surrounding country side, as well as sunsets, sunrises, snowstorms and stars at night.

20 Claims, 7 Drawing Sheets

FIG. 7
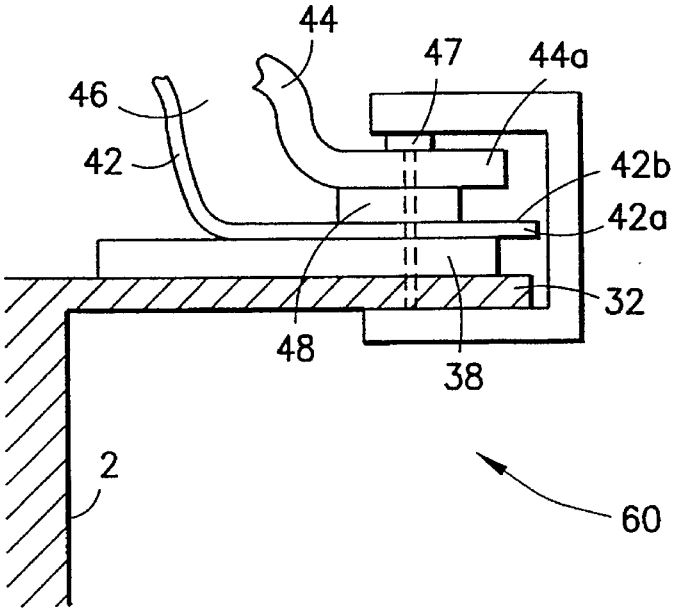
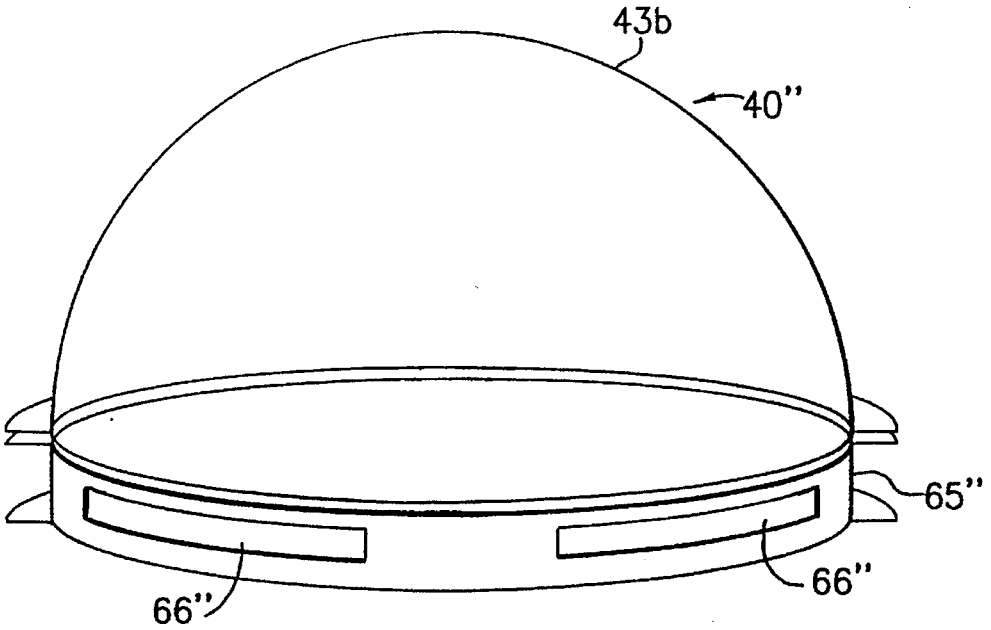
FIG. 10

ROOFTOP SKYLOUNGE HAVING HEMISPHERICAL DOME AND WRAPAROUND SEATING FOR PANORAMIC VIEWING OF COUNTRYSIDE, SNOWSTORMS, SUNSETS SUNRISES AND STARS

FIELD OF THE INVENTION

The present invention relates generally to a Skylounge for panoramic viewing of surrounding countryside, snowstorms, sunsets, sunrises and stars from a rooftop of a house.

RELATED PRIOR ART

Figure 1:
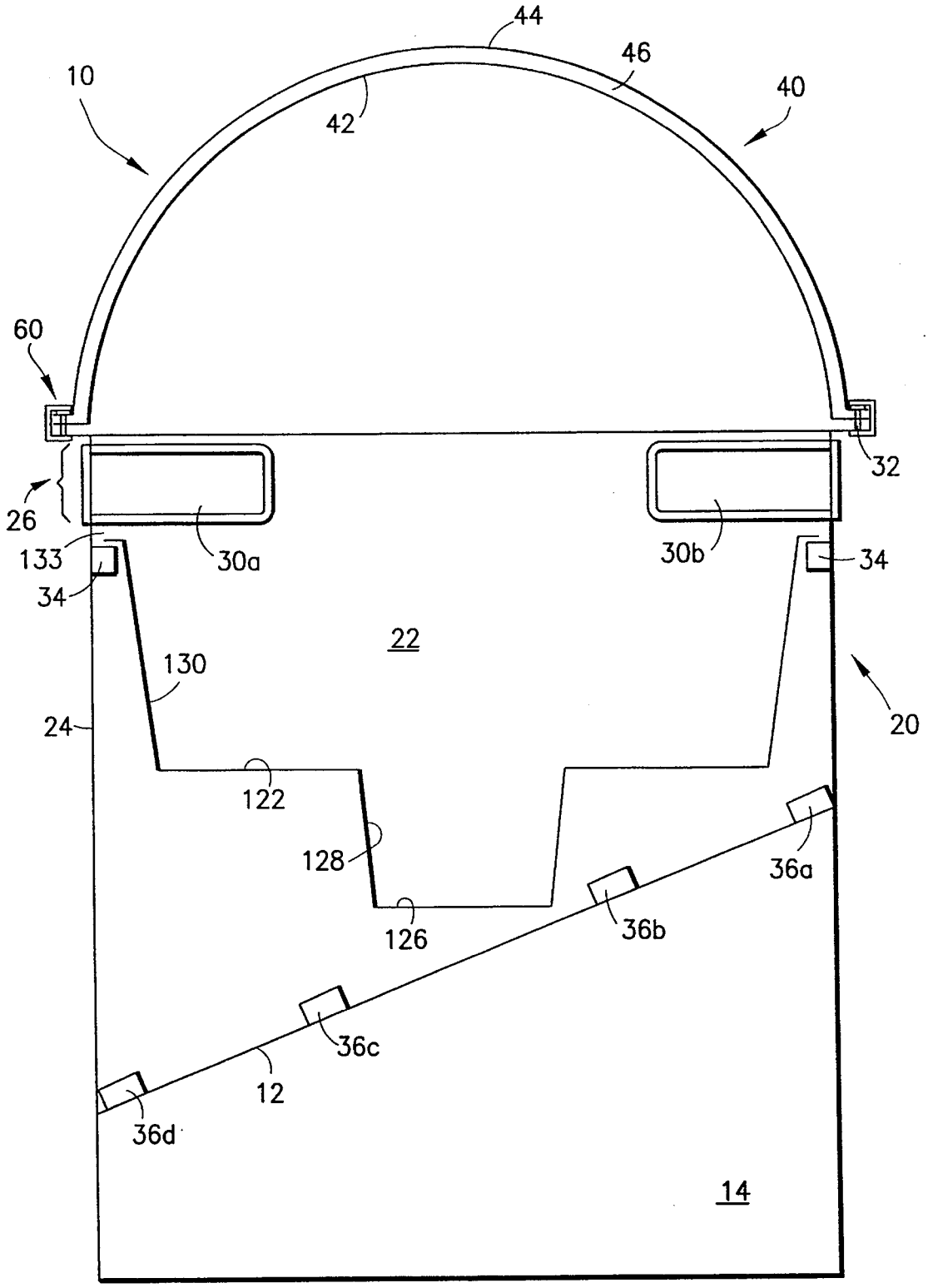
Figure 2:
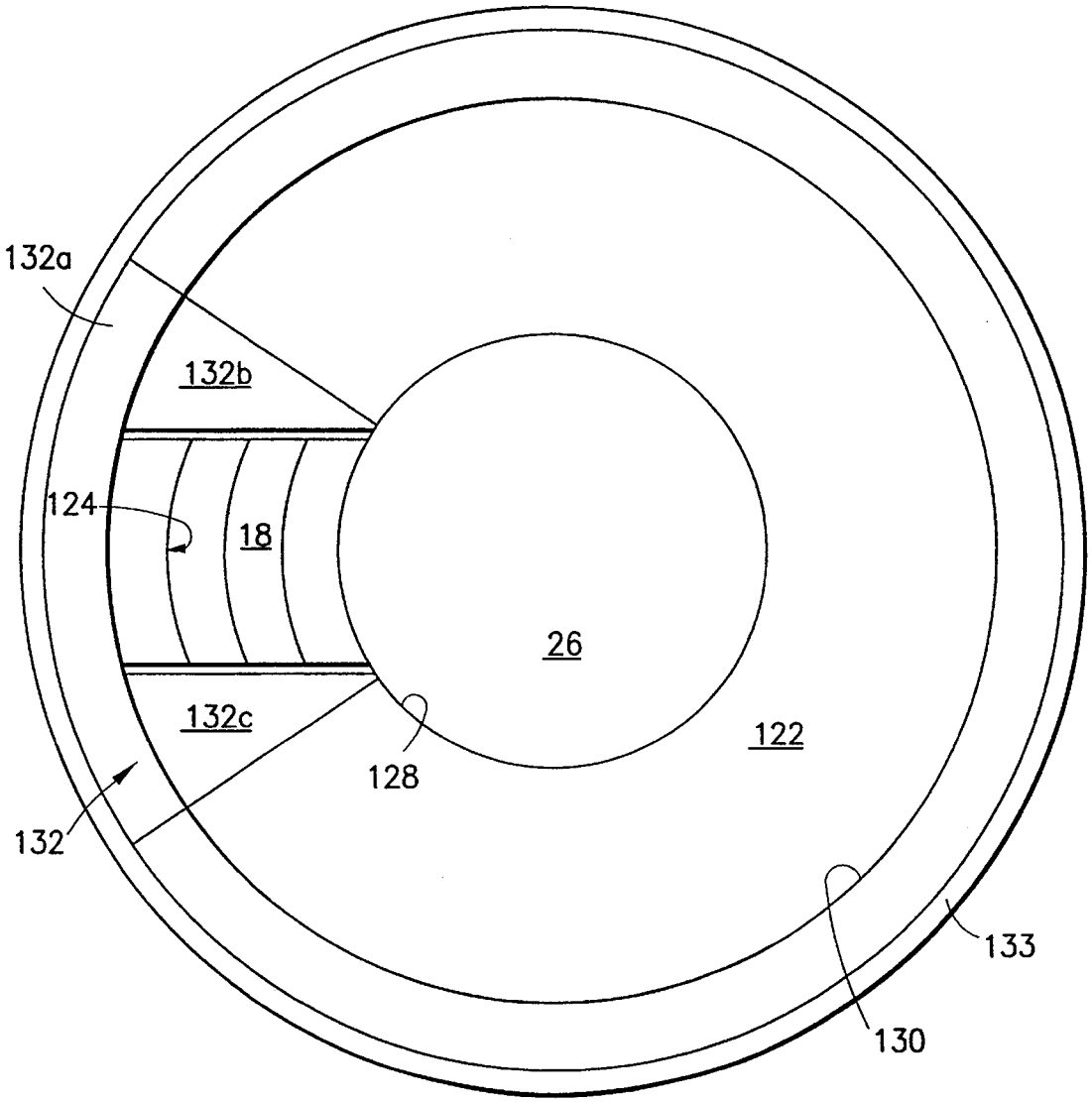
Figure 3:
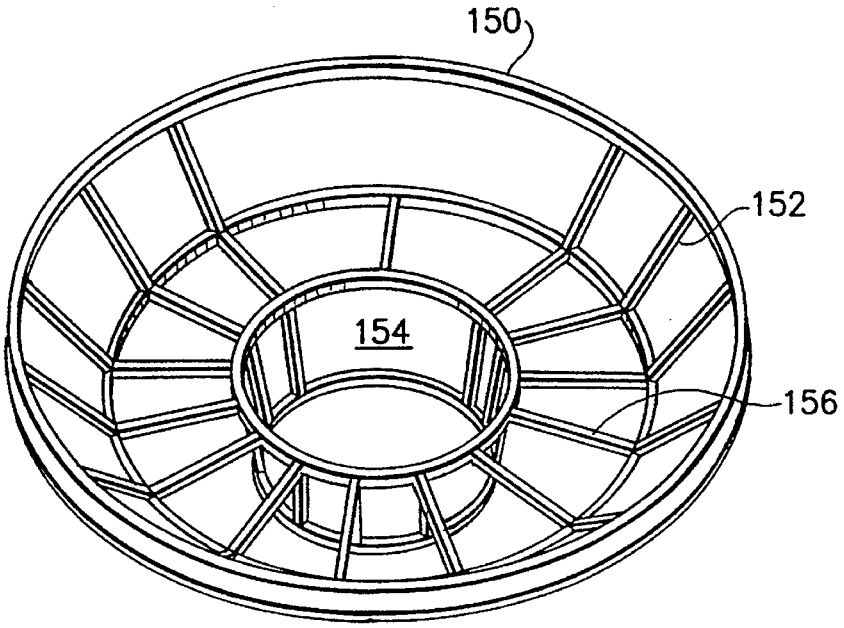

The following is related prior art developed in a prior art search: U.S. Pat. No. 106,967, issued to Snead, discloses a skylight as shown in FIG. 1 having a spherical glass dome H mounted on a shoulder of a frame A on a roof. U.S. Pat. No. 2,258,724, issued to Wagner et al. discloses an aircraft window pane in FIG. 3 having a hemispherical pane 1' mounted to an annular frame 14 that is attached to an outer wall of the aircraft. U.S. Pat. No. 2,659,462, issued to Schwartz et al., discloses a plastic hemispheric dome 1 for an airplane as shown in Figure i and attached as shown in FIG. 2. U.S. Pat. No. 3,212,220, issued to Boniecki et al., discloses a building structure having ovaloid shape designed for use as a fallout shelter or as an extra room for a house, as shown in FIGS. 1 and 2. The building structure may be formed of fiberglass with a top made of transparent plastic. U.S. Pat. No. 3,455,069, issued to Keyes, discloses a building structure having a hemispherical skylight 13 mounted on the roof, as shown in FIGS. 1–3. U.S. Pat. No. 3,475,868, issued to Johnson, discloses a structure having a light controlling means. As shown in FIGS. 1 and 2, a building structure has a part thereof above ground being formed of hemispherical walls or shells 11 and 12. The walls 11, 12 are transparent to light and the space between the walls may be filled with a liquid of varying opacity. U.S. Pat. No. 4,963,009, issued to Gernet, shows a transparent viewing window designed in spherical form to permit an observer to position his head, as shown in FIG. 1. U.S. Design Pat. No. 233,371, issued to Fila, shows a sun dome having an upper hemispherical part mounted on a cylindrical part.

SUMMARY OF THE INVENTION

The invention features a Skylounge for mounting over an opening cut into a roof of a house. The Skylounge includes a base member and a clear hemispheric dome means. The base member has mounting means for fastening to the roof of the house, has an entry opening for permitting users to enter the Skylounge through the opening cut in the roof of the house, and has a wraparound seating area for seating 6 adult users. The clear hemispheric dome means has means for fastening to the base member, for providing users seated on the wraparound seating area a panoramic view of the surrounding country side, sunrises, snowstorms and stars at night from the rooftop of the house.

In one embodiment, the clear hemispheric dome means includes two hemispheric domes, including an inner hemispheric dome and an outer hemispheric dome, having an air gap therebetween. The air gap eliminates fogging on the inside surface of the inner hemispheric dome. One of the two hemispheric domes has a protective layer for blocking ultraviolet light such as a bronze coating. The clear hemispheric dome means has a C clamp molding design for firmly attaching the two hemispheric domes to the base member.

The base member includes a flat floor area connected for supporting the feet of the 6 adult users seated on the wraparound seating area, a lower cylindrical wall arranged about the flat floor area and supporting the wraparound seating area, and an upper cylindrical wall surrounding the wraparound seating area and providing back support for the 6 adult users seated on the wraparound seating area. The entry opening is defined by corresponding breaks in the wraparound seating area, the lower cylindrical wall, the upper cylindrical wall and even the flat floor area. The Skylounge has a console area surrounding the entry opening and raised above the wraparound seating area for supporting accessories including a light, a telephone, a television, a VCR, a CD player, AC and a heating unit.

The base member can be made from a metallic frame with plywood sheets attached thereto for providing the wraparound seating area, the flat floor area, the lower and upper cylindrical walls.

The base member includes an outer protective wall that has an upper wall portion extending above the upper cylindrical wall of the base member. The outer protective wall provides outer structural support, provides height to the Skylounge, and has a supporting rim for receiving the clear hemispheric dome means. The upper wall portion of the protective wall may also have sliding windows for providing natural cross ventilation inside the clear hemispheric dome means of the Skylounge to help minimize fogging therein.

The base member and outer protective wall may also be molded from fiberglass.

The outer protective wall has either inside or outside mounting brackets for firmly attaching the Skylounge to the roof of the house. Flashing is provided around the bottom of the outer protective wall and the roof to provide a watertight seal to prevent water from seeping underneath the Skylounge.

Accordingly, a principal object of the present invention is to provide a Skylounge to allow homeowners panoramic viewing of the surrounding country side, as well as sunsets, sunrises, snowstorms and stars at night right from on their rooftop.

A principal advantage of the present invention is to provide a Skylounge which is comfortable and economical and can be either installed on a roof of a new home or retrofit on a roof of an existing home, and which does not have fogging inside or outside the clear hemispherical dome.

None of the known patents discussed above suggests a Skylounge for mounting on a rooftop of a home for panoramic viewing of the surrounding country side, as well as sunsets, sunrises, snowstorms and stars at night which eliminates the problem of fogging. Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

A DESCRIPTION OF THE DRAWING

Figure 4:
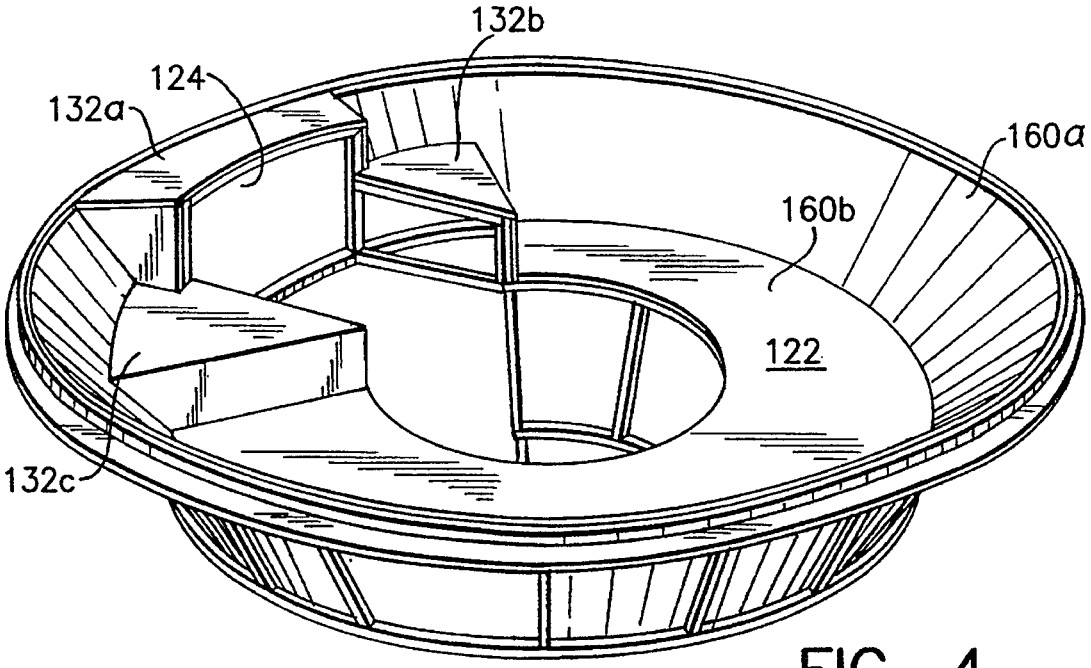
Figure 5:
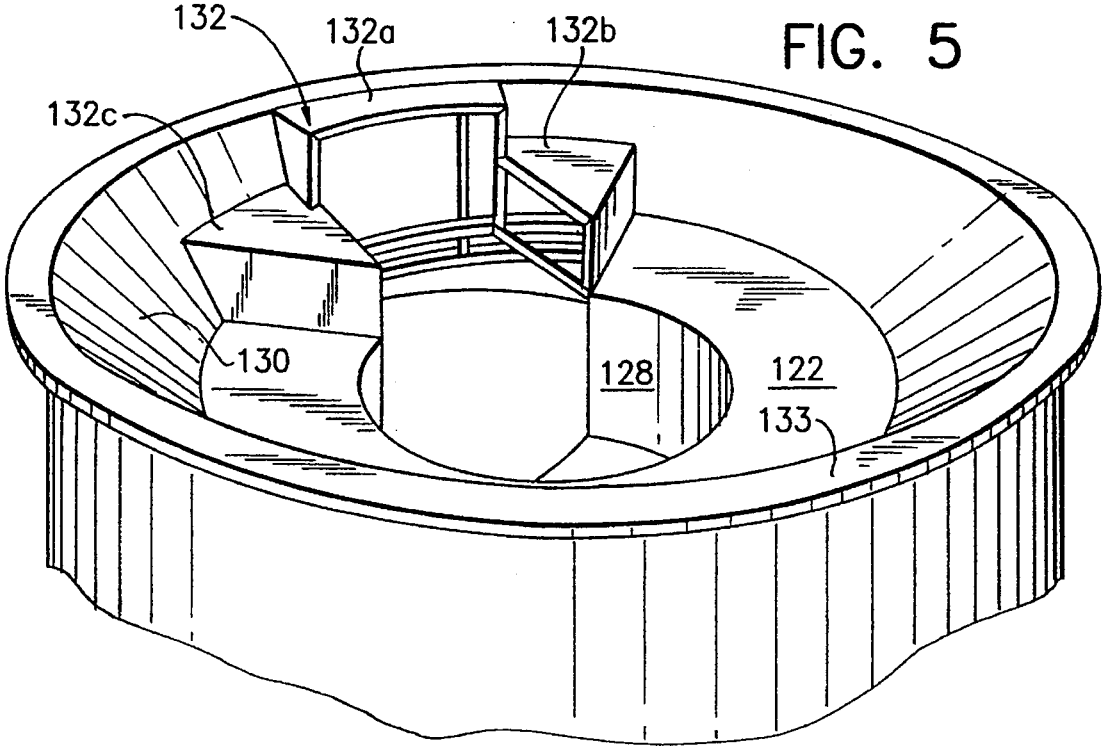
Figure 6:
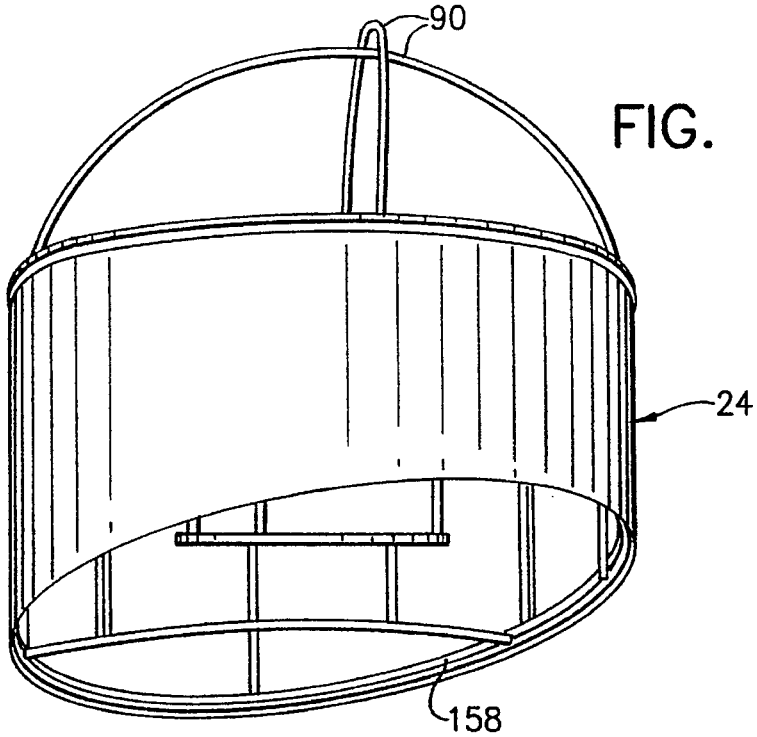
Figure 8:
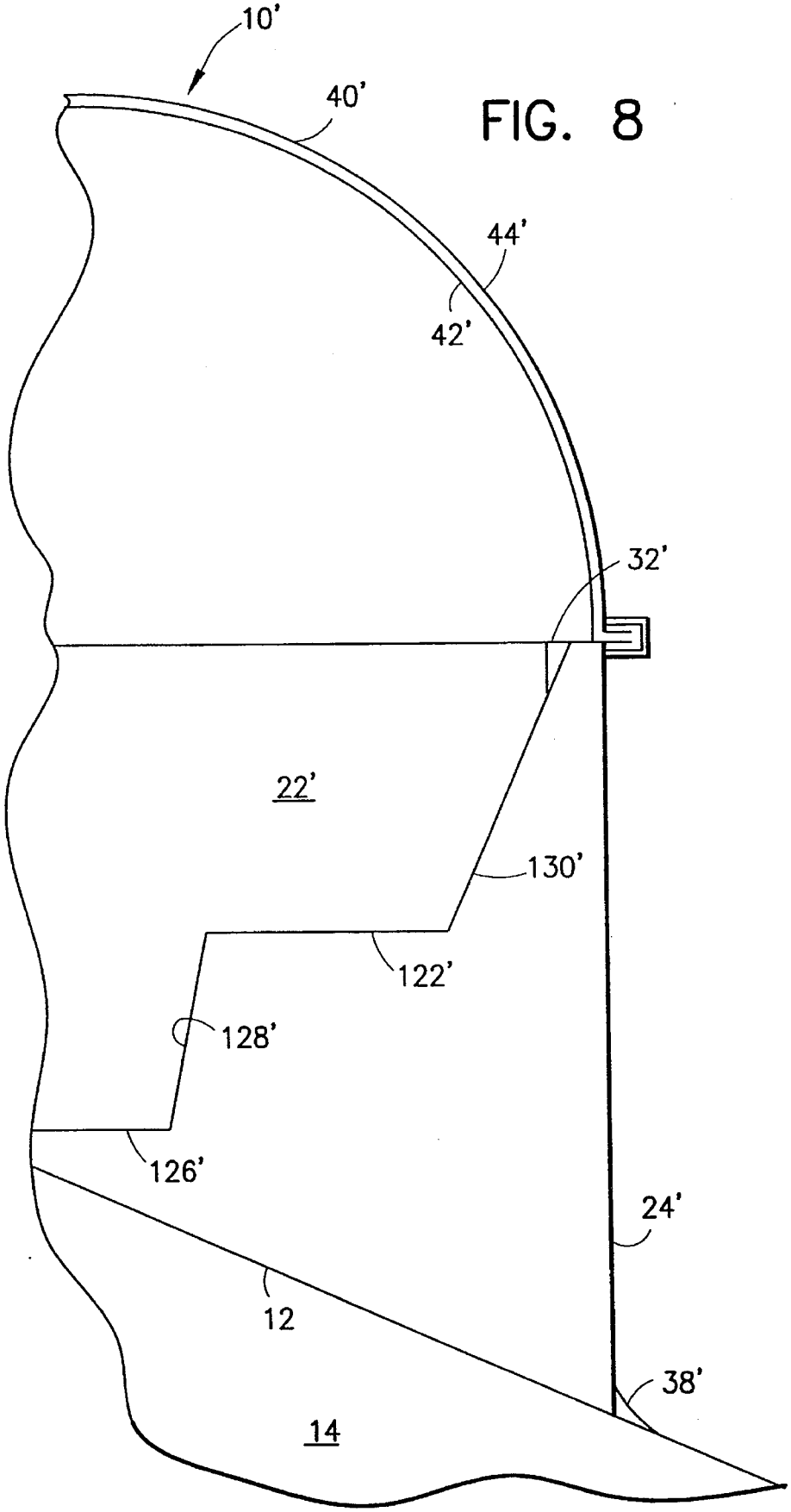
Figure 9:
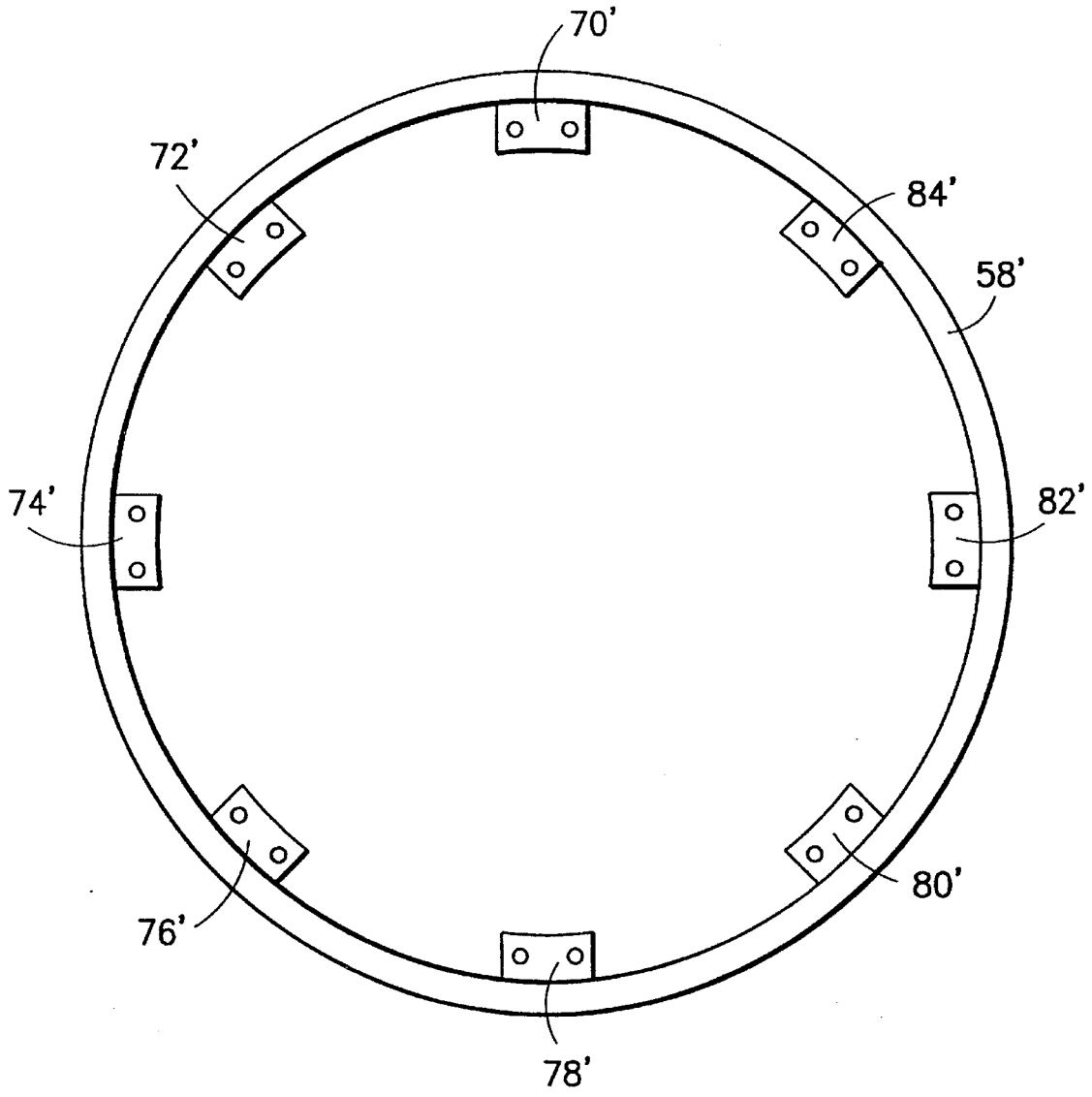

For a fuller understanding of the nature and objects of the invention, reference should be made to the following detailed description taken in connection with the accompanying drawings, not in scale, in which:

FIG.1 diagram of a side view of one embodiment of a skylounge of the present invention;

FIG. 2 is a top-down view of the Skylounge in FIG. 1;

FIG. 3 a perspective of a metal frame of a base member of the skylounge in FIG. 2;

FIG. 4 is another perspective of the metal frame of the base shown in FIG. 3 partially fitted with plywood;

FIG. 5 is another perspective of the metal frame of the base shown in FIGS. 3 and 4 partially fitted with plywood having an outer protective wall; FIG. 6 is a side view of the base member shown in FIG. 5; FIG. 7 is a diagram of the connecting means 60 of the clear hemispheric dome shown in FIG. 1; FIG. 8 is a split view sketch of another embodiment of the Skylounge; FIG. 9 is a sketch of mounting brackets on the base of the Skylounge; and FIG. 10 is a diagram of another embodiment of the Skylounge.

BEST MODE FOR CARRYING OUT THE INVENTION

As shown in FIG. 1, the Skylounge 10 is a versatile bubble-like room having about an 8 foot diameter for mounting onto new homes and for retrofitting onto older homes, which will seat 6 adults. The Skylounge 10 is adapted to a roof 12 of a house 14, can be installed to most roof angles, and is designed as a fully functional room ready for immediate use year round.

The Skylounge 10 has a base member generally indicated as 20 and a clear hemispheric dome means generally indicated as 40. The base member has means for securely attaching the Skylounge 10 to the roof 12 of the house 14. The clear hemispheric dome means 40 has connecting means generally indicated as 60 for firmly fastening to the base member 20. The Skylounge 10 provides users seated in the wraparound seating area 122 of the base member 20 a panoramic view through the clear hemispheric dome of the surrounding country side, as well as sunsets, sunrises, snowstorms and stars at night from the roof 12 of the house 14.

The base member 20 has a shell portion 22 for seating the 6 adults and an outer protective wall 24 for protecting and covering the shell portion 22. The outer protective wall 24 has an upper wall portion generally indicated as 26 with two windows 30*a* and 30*b* and two support rims 32 and 34. The upper wall portion 26 is defined as the area of the outer protective wall 24 between the top thereof and the supporting rim 34. The sliding windows 30*a*, 30*b* may have screens and provide natural cross ventilation to further eliminate fogging, especially inside the clear hemispheric dome means 40. The upper wall portion 26 may also be dimensioned to add a desired height to the overall Skylounge 10. In one embodiment, the upper wall portion has a height of about 7 inches, adding about 7 inches between the top of the shell portion 22 and the clear hemispheric dome means 40 and providing an effective and comfortable 7 foot clearance between the top of the clear hemispheric dome means 40 and the flat floor area 126 so that a 6 foot adult can stand erect on the flat floor area 126 without hitting their head on the top of the clear hemispheric dome means 40. However, the height of the upper wall portion 26 may be chosen in a range of 2 inches to 10 inches to provide the desired inside height of the Skylounge 10. The only limitation being that it should not be too high so that users cannot see over it when seated on the seating area 122. The outer protective wall 24 has mounting brackets 36*a*, 36*b*, 36*c*, 36*d* for firmly affixing the Skylounge 10 to the roof 12 of the house 14. The mounting brackets 36*a*, 36*b*, 36*c*, 36*d* may be arranged inside or outside the outer protective wall 24. Flashing not shown in FIG. 1 is arranged around the bottom of the outer protective wall 24 to provide an easy watertight structural mount with a custom fit to prevent water from seeping underneath the Skylounge 10. As shown, the outer protective wall 24 is angled and contoured to correspond to the angle of the roof 12 of the house 14 for mounting thereon.

The clear hemispheric dome means 40 includes two hemispheric domes, including an inner hemispheric dome 42 and an outer hemispheric dome 44, having an air gap designated as 46 therebetween. The air gap 46 eliminates fogging for example on the inside surface 42*a* of the inner hemispheric dome 42 by providing a temperature buffer. The air gap 46 may be filled with atmospheric air, or with an inert gas such as argon. Either the inner hemispheric dome 42 or the outer hemispheric dome 44, or both may have an outer protective layer for blocking ultraviolet light and to minimizes the heating effects of sunlight. As shown, the outer hemispheric dome 44 has an outer protective layer 44*a* such as a bronze coating. The connecting means 60 firmly attaches the inner and outer hemispheric domes 42, 44 together in an airtight manner and attaches them to the base 20, as discussed below with respect to FIG. 7.

As shown in FIGS. 1–2, the shell portion 22 fits inside the outer protective wall 24 and rests on the supporting rim 34. The shell portion 22 has a wraparound seating area 122 and can be equipped with comfortable carpet and suitable lighting in various colors for establishing a desired mood inside the Skylounge 10 and/or a desired visual effect when the Skylounge is viewed from the outside. The Skylounge 10 may be equipped with a TV/VCR unit, a phone jack, a cassette-CD stereo, a heating unit, air conditioning, etc.

The Skylounge 10 is mounted over an opening cut (not shown) in the roof 12 of the house 14 in FIG. 1. The opening cut (not shown) in the roof 12 is usually a 30 inch by 40 inch opening cut and framed through the roof 12 into an attic or other room in the house 12, as discussed below. The shell portion 22 has an entry opening 124 (see also FIGS. 3–6) for permitting users to enter the Skylounge 10 through the opening cut (not shown) in the roof 12 of the house 14, and has a wraparound seating area 122 for seating 6 adult users. As shown in FIGS. 2–3, the wraparound seating area 122 is about 19 inches wide measured along the radius of the base 20.

The shell portion 22 includes a flat floor area 126, a lower cylindrical wall 128, an upper cylindrical wall 130, and a 6 inch circumferential rim 133. The flat floor area 126 has a diameter of about 36 inches connected for supporting the feet of the 6 adult users seated in the wraparound seating area 122. The lower cylindrical wall 128 is about 18 inches high arranged above the floor area 126 and supporting the wraparound seating area 122. The upper cylindrical wall 130 has a length of about 20 inches for surrounding the wraparound seating area 122 and providing back support for the 6 adult users seated in the wraparound seating area 122.

As best shown in FIGS. 2, the entry opening 124 is defined by a cut or break in the wraparound seating area 122, the lower cylindrical wall 128, and the upper cylindrical wall 130. See also FIGS. 3–6 discussed below. The flat floor area 126 may also be cut if the entry opening needs to be larger. Stairs 18 allow the users to climb into the Skylounge 10 from inside the house 14.

As shown in FIG. 2, the Skylounge 10 has a console area generally indicated as 132 raised about the wraparound seating area 122 and surrounding the entry opening 124 for supporting accessories including a light, a telephone, a television, VCR, a CD player, AC and a heating unit. The console area 132 includes an upper shelf 132*a* and two side shelves 132*b*, 132*c*. See also FIG. 5.

FIGS. 3–6 show the shell portion 22 which is made of a metallic frame generally indicated as 150 with plywood sheets generally indicated as 160 attached thereto for providing the wraparound seating area 122, the flat floor area 126, the lower cylindrical wall 128, and the upper cylindrical wall 130, the console area 132, etc. As shown, the metallic frame 150 includes an upper cylindrical frame portion 152 for attaching plywood 160*a* to form the upper cylindrical wall 130, a lower cylindrical frame portion 154 for attaching plywood 160*b* to form the lower cylindrical wall 128, and a ring-like frame 156 connecting the upper cylindrical frame portion 152 and the lower cylindrical frame portion 154 for attaching plywood 160*c* to form the wraparound seating area 122.

Alternatively, the shell portion 22 and the outer protective wall 24 may be molded as an integral unit from fiberglass (not shown) in various colors.

FIG. 7 shows the connection means 60 for fastening the clear hemispheric dome means 40 to the base member 20. As shown, the inner hemispheric dome 42 has an inner circumferential lip 42*a* that rests on a rubber seal 38 of a supporting circumferential rim 32 of the base member 20. A rubber or neoprene seal 48 is arranged on the upper surface 42*b* of the inner hemispheric dome 42. The outer hemispheric dome 44 also has an outer circumferential lip 44*a* that rests on of the rubber or neoprene seal 48. The inner circumferential lip 42*a* and the outer circumferential lip 44*a* have a multiplicity of predrilled 42holes spaced around the circumference of the lips 42*a*, 44*a* of the inner and outer hemispheric domes 42, 44 respectively for receiving screws, nails, rivets or any other suitable means generally indicated as 47 for firmly fastening the inner and outer hemispheric domes 42, 44 together in an airtight manner and also to the supporting circumferential rim 32 of the base member 20. A C-clamp molding made of vinyl or metal is fastened over the inner circumferential lip 42*a*, the outer circumferential lip 44*a* and the supporting rim 32 to provide a firm connection which has an aesthetic appearance.

FIG. 8 shows an alternative embodiment of the Skylounge 10 wherein the clear hemispheric dome means 40 rests on a rim 32' of the outer protective wall 24' which does not have an upper wall portion. As shown, the upper cylindrical wall 130' has a conical shape angled at about 70 degrees with respect to the wraparound seating area 122. The shell portion 22' is surrounded by an outer protective wall 36' and flashing 38' provides an easy watertight structural mount with a custom fit to prevent water from seeping underneath the Skylounge 10.

As shown in FIG. 9, the mounting frame 150 of the shell portion 22' has a mounting frame 58' having mounting brackets 70', 72', 74', 76', 78', 80', 82', 84' and 86' for also affixing the Skylounge 10 to the roof 12 of the house 14. In addition, the mounting brackets 70', 72', 74', 76', 78', 80', 82', 84', are suitably angled to correspond to the angle of the roof 12. The mounting brackets 70', 72', 74', 76', 78', 80', 82', 84', can be used together with the mounting brackets 36*a*, 36*b*, 36*c*, 36*d* of the outer protective wall 24 to strongly mount the Skylounge to the roof 12.

FIG. 10 shows an embodiment of the invention in which the Skylounge 10 has a riser member 65" arranged between the shell portion 22' and the clear hemispheric dome means 40' shown in FIG. 8. The riser member 65" has sliding windows 66" with or without screens for providing natural cross ventilation. The riser member 65" is analogous to the upper wall portion 26 of the outer protective wall but only comes as a separate unit. It adds desired height to the overall Skylounge 10. In one embodiment, the riser member 65" is 7 inches in height and arranged between the shell portion 22' and the hemispheric dome means 40' and has four diametrically opposed 3 inches high and 16 inches wide sliding windows 66" for providing very good natural cross ventilation and providing the inner hemispheric dome 42' with a comfortable 7 foot clearance. The Skylounge 10 is dimensioned with at least a 7 foot clearance from the top of the clear hemispheric dome means 40' and the flat floor area 126 so that a 6 foot adult can stand erect on the flat floor area 126 without hitting their head on the top of the inner hemispheric dome 42. However, a longer riser member 65" may be used to increase or decrease the desired inside height of the Skylounge 10'. The base member 20 has a desired radius of about 8 feet.

The Skylounge 10 will be crated and delivered to the job sites. Most installations of a Skylounge 10 can be completed in one day. During installation, the roofing shingles will be removed from the roof 12 around the determined location. Once the installation area is prepared, the 30 inch×40 inch opening is cut and framed through the roof 12 into the home or attic. This usually involves cutting one of the seven roof rafters (not shown). After which, the Skylounge 10 is ready to be lifted by the lift rings 90 ( see FIG. 6) located on the top of the crating with the use of a small crane (not shown), and the Skylounge 10 is set on the roof 12. The mounting brackets 70', 72', 74', 76', 78', 80', 82', 84', and 86' and/or the mounting brackets 36*a*, 36*b*, 36*c*, 36*d* located inside the pre-cut angle of the outer protective 36 wall are affixed the Skylounge 10 to the roof 12. If necessary, wood blocking may be added between roof beams (not shown) to accept mounting hardware. When this is complete, the Skylounge 10 can be fully uncrated, then step flashed with flashing 38 shown in FIG. 8 into the roof 12 to complete a structural and water tight installation. For a roof top application on an existing home a permit may be required, so one must check with your local town for building codes.

Embodiments are also envisioned in which the Skylounge 10 can be produced as a unit for backyard applications.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A skylounge mounted over an opening cut into a roof of a house, comprising:

a base member having means firmly attaching said skylounge to the roof of the house, said base member having an entry opening for permitting users to enter said skylounge through said opening cut in the roof of the house, said base member having a wraparound seating area for seating 6 users; and clear hemispheric dome means having means connecting to said base member for providing users seated on said wraparound seating area of the base member a panoramic view from the roof of the house for viewing the surrounding country side, as well as sunsets, sunrises, snowstorms and stars at night.

2. A skylounge according to claim 1, wherein said clear hemispheric dome means comprises a pair of domes having an airgap inbetween.

3. A skylounge according to claim 2, wherein said one of said pair of domes has a protective layer for blocking ultraviolet light.

4. A skylounge according to claim 1, wherein said clear hemispheric dome means includes an inner clear hemispheric dome with an inner circumferential lip, wherein a rubber or neoprene seal is arranged on an upper surface of the inner circumferential lip, wherein said clear hemispheric dome means has an outer hemispheric dome having an outer circumferential lip that rests on the rubber or neoprene seal for providing an airgap in between the inner clear hemispheric dome and the outer hemispheric dome.

5. A skylounge according to claims 4, wherein the inner circumferential lip of the inner clear hemispheric dome rests on a rubber seal of a supporting circumferential rim of the base member, wherein the inner circumferential lip and the outer circumferential lip have a multiplicity of predrilled holes spaced around the circumference thereof, wherein the connecting means includes means for fastening that penetrate said multiplicity of predrilled holes for connecting the inner and outer hemispheric domes together in an airtight manner and also to the supporting circumferential rim of the base member.

6. A skylounge according to claim 5, wherein the connection means also includes a C clamp molding made of vinyl or metal for placing over the supporting circumferential rim of the base member, the inner circumferential lip of the inner dome and the outer circumferential lip of the outer dome for providing a firm connection as well as enhancing the aesthetic appearance thereof.

7. A skylounge according to claim 1, wherein said base member includes a shell portion having a lower cylindrical wall arranged about a flat floor area and supporting said wraparound seating area, and includes an upper cylindrical wall for surrounding said wraparound seating area and providing back support for said 6 users seated on said wraparound seating area.

8. A skylounge according to claim 7, wherein said upper cylindrical wall has a conical shape.

9. A skylounge according to claim 8, wherein said lower cylindrical wall has a height of about 18 inches for raising said wraparound seating area above said floor.

10. A skylounge according to claim 7, wherein said shell portion includes a metallic frame with plywood sheets attached thereto for providing the wraparound seating area, the flat floor area, the lower and upper cylindrical walls.

11. A skylounge according to claim 10, wherein said metallic frame includes an upper cylindrical frame portion for attaching plywood to form the upper cylindrical wall, a lower cylindrical frame portion for attaching plywood to form the lower cylindrical wall, and a ring-like frame connecting said upper cylindrical frame portion and lower cylindrical frame portion for attaching plywood to form the wraparound seating portion.

12. A skylounge according to claim 11, wherein said riser is about 7 inches and each of said plurality of sliding windows is 3 inches high by 16 inches wide.

13. A skylounge according to claim 7, wherein said skylounge is dimensioned with at least a 7 foot clearance from the top of said clear hemispheric dome means and said floor area so that a 6 foot adult can stand erect on said floor area without hitting their head on the top of said clear hemispheric dome, and said base member has a radius of about 8 feet.

14. A skylounge according to claim 7, wherein said entry opening is defined by corresponding openings in said lower cylindrical wall, said upper cylindrical wall or said wraparound seating area.

15. A skylounge according to claim 1, wherein said base member is molded from fiberglass.

16. A skylounge according to claim 1, wherein said base member has a plurality of mounting brackets for affixing said skylounge to said roof of said housing.

17. A skylounge according to claim 1, wherein said skylounge further comprises a console area raised about said wraparound seating area and surrounding said entry opening for supporting accessories including a light, a telephone, a television, a CD player and a heating unit.

18. A skylounge according to claim 1, wherein said skylounge further comprises an outer protective wall having an upper wall portion and a supporting rim for surrounding said base member and receiving said clear hemispheric dome means.

19. A skylounge according to claim 1, wherein said skylounge further comprises a riser member arranged between said base member and said clear hemispheric dome means, having a plurality of sliding windows for providing natural cross ventilation and eliminating fogging.

20. A skylounge to be mounted over an opening cut into a roof of a house, comprising:

a base member having means for firmly attaching said skylounge to the roof of the house, said base member having an entry opening for permitting users to enter said skylounge through said opening cut in the roof of the house, said base member having a wraparound seating area for six users; and clear hemispheric dome means having means connecting to said base member for providing users seated on said wraparound seating area of the base member a panoramic view from the roof of the house for viewing the surrounding country side, as well as sunsets, sunrises, snowstorms, and stars at night; said clear hemispheric dome means comprising a pair of domes having an airgap inbetween.

* * * * *

UNITED STATES PATENT AND TRADEMARK OFFICE

CERTIFICATE OF CORRECTION

PATENT NO. : 5,600,925

DATED : February 11, 1997

INVENTOR(S) : Hoogervorst

It is certified that error appears in the above-indentified patent and that said Letters Patent is hereby corrected as shown below:

On the title page item [54] and at Column 1, line 5, "ROOFTOP SKYLOUNGE HAVING HEMISPHERICAL DOME AND WRAPAROUND SEATING FOR PANORAMIC VIEWING OF COUNTRYSIDE, SNOWSTORMS, SUNSETS SUNRISES AND STARS" should read --ROOFTOP SKYLOUNGE HAVING HEMISPHERICAL DOME AND WRAPAROUND SEATING FOR PANORAMIC VIEWING OF COUNTRYSIDE, SNOWSTORMS, SUNSETS, SUNRISES AND STARS--

Column 1, line 25, "an airplane as shown in Figure i" should read --an airplane as shown in Figure 1--

Column 3, line 1, "FIG. 1 diagram" should read --FIG. 1 is a diagram--

Column 3, line 4, "FIG. 3 a perspective" should read --FIG. 3 is a perspective--

Column 4, lines 17-18, "and to minimizes the heating" should read --and to minimize the heating--

Column 5, line 28, "that rests on of the" should read --that rests on the--

Column 5, line 31, "predrilled 42holes" should read --predrilled holes--

Column 5, line 58, "84', are suitably angled to" should read --84' are suitably angled to --.

Column 5, line 59, "84', can" should read --84' can--

UNITED STATES PATENT AND TRADEMARK OFFICE

CERTIFICATE OF CORRECTION

PATENT NO. : 5,600,925
DATED : February 11, 1997
INVENTOR(S) : Hoogervorst

It is certified that error appears in the above-indentified patent and that said Letters Patent is hereby corrected as shown below:

Column 6, line 32, "36 wall" should read --wall 36--

Column 6, line 32, "are affixed the" should read --affix the--

Signed and Sealed this

Sixteenth Day of June, 1998

*Attest:*

*Attesting Officer*

Bruce Lehman

BRUCE LEHMAN

*Commissioner of Patents and Trademarks*